US009545557B2

(12) United States Patent
Yi

(10) Patent No.: US 9,545,557 B2
(45) Date of Patent: Jan. 17, 2017

(54) SNOW SLIDING APPARATUS

(71) Applicant: Ji Ha Yi, Seoul (KR)

(72) Inventor: Ji Ha Yi, Seoul (KR)

( * ) Notice: Subject to any disclaimer, the term of this patent is extended or adjusted under 35 U.S.C. 154(b) by 0 days.

(21) Appl. No.: 14/760,499

(22) PCT Filed: Jan. 13, 2014

(86) PCT No.: PCT/KR2014/000350

§ 371 (c)(1),
(2) Date: Oct. 26, 2015

(87) PCT Pub. No.: WO2014/109612

PCT Pub. Date: Jul. 17, 2014

(65) Prior Publication Data

US 2016/0051884 A1 Feb. 25, 2016

(30) Foreign Application Priority Data

Jan. 13, 2013 (KR) ..... 10-2013-0003710
Jan. 13, 2013 (KR) ..... 10-2013-0003713

(51) Int. Cl.

| | |
|---|---|
| ***A63C 11/00*** | (2006.01) |
| ***A63C 9/00*** | (2012.01) |
| ***A63C 11/20*** | (2006.01) |
| ***A63C 5/02*** | (2006.01) |
| *A63C 10/00* | (2012.01) |

(52) U.S. Cl.

CPC ..... *A63C 9/005* (2013.01); *A63C 5/02* (2013.01); *A63C 9/003* (2013.01); *A63C 11/20* (2013.01); *A63C 10/00* (2013.01); *A63C 2009/008* (2013.01)

(58) Field of Classification Search

CPC ..... A63C 11/16; A63C 11/26; A63C 7/02; A63C 7/04; A63C 7/06; A63C 5/003

See application file for complete search history.

(56) References Cited

U.S. PATENT DOCUMENTS

| | | | | |
|---|---|---|---|---|
| 7,374,207 | B2 * | 5/2008 | McCoy | A63C 5/062 280/809 |
| 2008/0185818 | A1 | 8/2008 | Riepler et al. | |
| 2009/0250905 | A1 * | 10/2009 | Girard | A63C 5/003 280/607 |
| 2010/0148457 | A1 | 6/2010 | Holzer et al. | |
| 2011/0012335 | A1 * | 1/2011 | Jones | A63C 5/062 280/809 |

FOREIGN PATENT DOCUMENTS

| | | |
|---|---|---|
| KR | 20-2009-0011136 U | 10/2009 |
| KR | 10-2010-0089435 A | 8/2010 |

OTHER PUBLICATIONS

International Search Report for PCT/KR2014/000350 mailed May 30, 2014 from Korean Intellectual Property Office.

* cited by examiner

*Primary Examiner* — Erez Gurari
(74) *Attorney, Agent, or Firm* — Paratus Law Group, PLLC

(57) ABSTRACT

A snow sliding apparatus for enabling sliding along a surface of snow, including: a plate-shaped deck configured to extend in a direction; and an auxiliary sliding part configured such that at least part thereof protrudes from both sides of the deck to have a width broader than and equal to that of edges of the deck, and configure to extend in a lengthwise direction of the deck, thereby protecting the edges of the deck during riding or assisting riding of the deck.

16 Claims, 12 Drawing Sheets

SNOW SLIDING APPARATUS

CROSS REFERENCE TO PRIOR APPLICATION

This application is a National Stage Patent Application of PCT International Patent Application No. PCT/KR2014/000350 (filed on Jan. 13, 2014) under 35 U.S.C. §371, which claims priority to Korean Patent Application NoS. 10-2013-0003710 (filed on Jan. 13, 2013) and 10-2013-0003713 (filed on Jan. 13, 2013), which are all hereby incorporated by reference in their entirety.

BACKGROUND

The present invention relates generally to a snow sliding apparatus, and more particularly to a snow sliding apparatus that enables sliding along the surface of snow, can be combined with various types of boots, and can protect edges.

Sports using apparatuses that enable sliding along the surface of snow are represented by skiing and snowboarding. Skis refers to an apparatus that enables a user to wear them on his or her feet and to adjust a direction using skis and ski sticks, and a snowboard refers to an apparatus that enables a user to ride with his or her feet on a single deck.

Furthermore, recently, pieces of equipment that are used with apparatuses having a short length worn on both feet of users without requiring separate ski sticks, such as a skiboard, have been developed and used.

Of these pieces of equipment, equipment having relatively short lengths, such as a snowboard and a skiboard, enables various techniques, and thus have been recently attracting a lot of attention.

These various types of snow sliding apparatuses have different widths and lengths, and thus the types and specifications of boots that are applied to the snow sliding apparatuses are various. For example, the widths of boots that are used for snowboards are broader than those of boots that are used for skis. Of the snowboards, alpine boards and freestyle boards employ different sizes of boots. Furthermore, even boots that are used for the same type of snow sliding apparatuses may have different specifications according to different manufacturers.

As described above, since these various types of snow sliding apparatuses require different types of boots, various problems arise when different types of boots are applied to snow sliding apparatuses. For example, when the width of boots is larger than that of a deck, the bottom surfaces of the boots of a snow sliding apparatus generate friction with the surface of snow, and thus a problem arises in that a user cannot easily ride using the snow sliding apparatus.

Additionally, various techniques can be implemented using the snow sliding apparatuses. Of these high-level techniques, there are techniques using obstacles. For example, there are various techniques, such as a technique of sliding along an obstacle at a height spaced apart from the surface of snow using the sliding apparatuses, etc.

However, a problem arises in that the snow sliding apparatuses are damaged when users slide along obstacles using the snow sliding apparatuses. More specifically, decks that generate friction with obstacles are worn by repeated riding. In particular, both side surfaces (edges) of the decks that actually generate fraction with obstacles are chiefly worn or damaged.

SUMMARY

Accordingly, the present invention is intended to overcome the above-described problems of the conventional art, and an object of the present invention is to enables various boots to be applied to a snow sliding apparatus, and to prevent direct friction between a boot and the surface of snow even when a boot broader than that of a deck is applied.

Another object of the present invention is to prevent the edges of a snow sliding apparatus from being easily worn even when a user rides along an obstacle.

According to an aspect of the present invention intended to accomplish the above-described objects, the present invention provides a snow sliding apparatus for enabling sliding along a surface of snow, including a plate-shaped deck configured to extend in a direction; and an auxiliary sliding part configured such that at least part thereof protrudes from both sides of the deck to have a width broader than and equal to that of edges of the deck, and configure to extend in the lengthwise direction of the deck, thereby protecting the edges of the deck during riding or assisting the riding of the deck.

Furthermore, the auxiliary sliding part may be combined with the outside surface of the deck and one side of a binding or boot, the deck may be further provided with a fastening frame that is provided on the top of the deck and is combined with the binding or boot, and the auxiliary sliding part may be combined with the fastening frame.

Meanwhile, the auxiliary sliding part may include a first body configured to extend a direction parallel to the deck and second bodies configured to protrude from both ends of the first body to have a width broader than and equal to that of edges of the deck, and the first body may be combined with any one of the deck, the fastening frame, and the binding.

Furthermore, the auxiliary sliding part may include a pair of parts and be provided on both sides of the deck, and the auxiliary sliding part comprises a first body extending in a direction parallel to the deck and second bodies extending in a direction perpendicular to the first body.

Additionally, the auxiliary sliding assembly may include a body part formed in a plate shape, side parts configured to extend from both sides of the body part in a direction perpendicular to the body part, and plate pieces detachably combined with the side parts.

Furthermore, a plurality of frame holes may be formed in the auxiliary sliding part, at least any one of a fastening tool, an extension frame and a deck accessory may be fastened to the frame holes, and the extension frame may be combined with the auxiliary sliding part, thereby protecting the edges of the deck or assisting the riding of the deck, along with the auxiliary sliding part.

In this case, the auxiliary sliding part may be rotatably provided with auxiliary sliding rolling wheels. The auxiliary sliding part may be combined with an outside surface of the deck and a binding, boot or fastening frame by a connector, and the distance from the center of the deck may be adjustable by the connector.

Additionally, a wear plate configured to prevent direct contact between the surface of snow and the boot or binding may be provided between the top surface of the deck and the bottom surface of the binding or boot combined with the deck. The auxiliary sliding part may be combined with the side surface or bottom surface of the wear plate, or may be integrated with the wear plate.

Furthermore, at least part of the wear plate may be formed in a thin plate shape extending in the lengthwise direction of the deck, and a first through hole configured to combine the binding or boot with the deck may be formed in the wear plate.

Meanwhile, the auxiliary sliding assembly may include two symmetrical parts, and an interval between these two parts may be variable. The auxiliary sliding part may be combined with the body part or side parts of the auxiliary sliding assembly by a fastener, and the distance from a center of the deck may be adjustable by the fastener.

Additionally, the wear plate and the auxiliary sliding assembly may be integrated with each other, or the wear plate, the auxiliary sliding assembly and the fastening frame may be integrated with one another. An assembly block may be detachably combined with the bottom surface of the wear plate.

Meanwhile, a first fastening hole and a second fastening hole may be formed in the wear plate and the assembly block, respectively, at corresponding locations, and the outside surfaces of the assembly block may be coated with a Teflon coating. The wear plate may be provided with plate rolling wheels, and at least part of each of the plate rolling wheels may protrude from the wear plate.

The following effects can be expected from the above-described snow sliding apparatus according to the present invention.

In the present invention, the snow sliding apparatus is provided with the wear plate and thus prevents direct friction between the bottom surface of a boot and the surface of snow, thereby achieving the effect of improving the compatibility of the snow sliding apparatus because various boots or bindings can be applied to the deck regardless of the sizes or types of boots or bindings, and also achieving the effect of preventing a boot from being worn during riding.

Additionally, the present invention is provided with the auxiliary riding part and protects the edges of the deck, and thus the edges are prevented from being worn or damaged by an obstacle even when a user rides along various obstacles, such as guardrails or rails, using the deck, thereby achieving the effect of improving the durability of the deck.

Furthermore, in the present invention, the interval between the wear plate and the auxiliary sliding part is variable and the present invention can be applied to various sizes of boots or bindings, and thus it is not necessary to replace the wear plate or auxiliary sliding part accordingly even when a boot or binding is replaced, thereby improving user convenience.

Additionally, in the present invention, the height from the surface of snow to a boot can be adjusted by adjusting the fastening frame and the number of damper spacers that may be selectively combined with the fastening frame, and accordingly a user can freely set a height desired by the user, thereby achieving the effect of improving the manipulability of the snow sliding apparatus.

Figure 8:
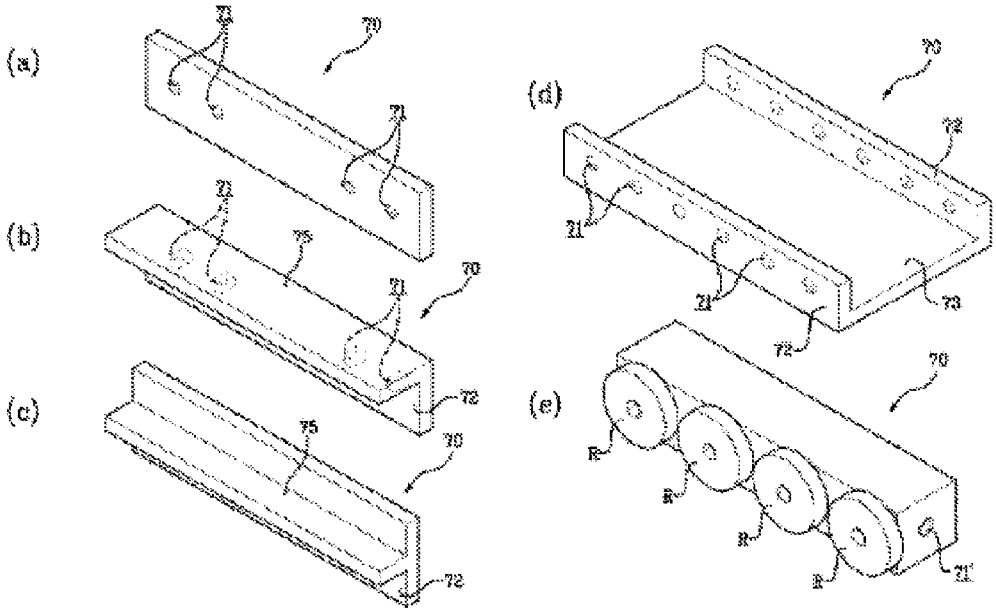
Figure 9:
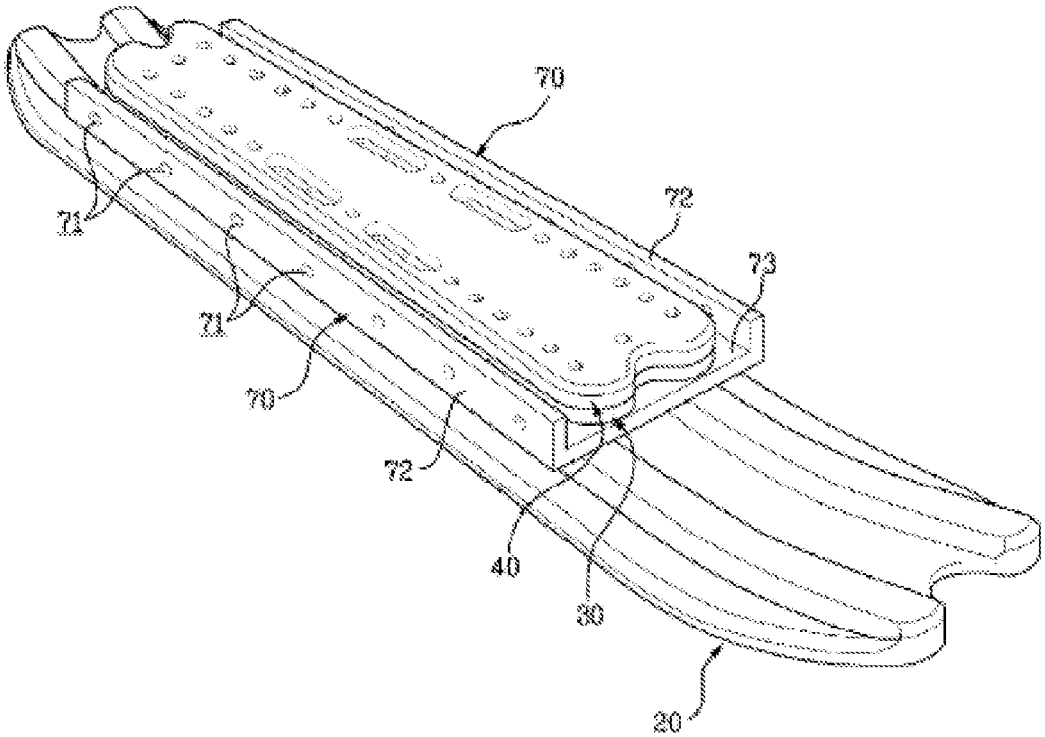
Figure 10:
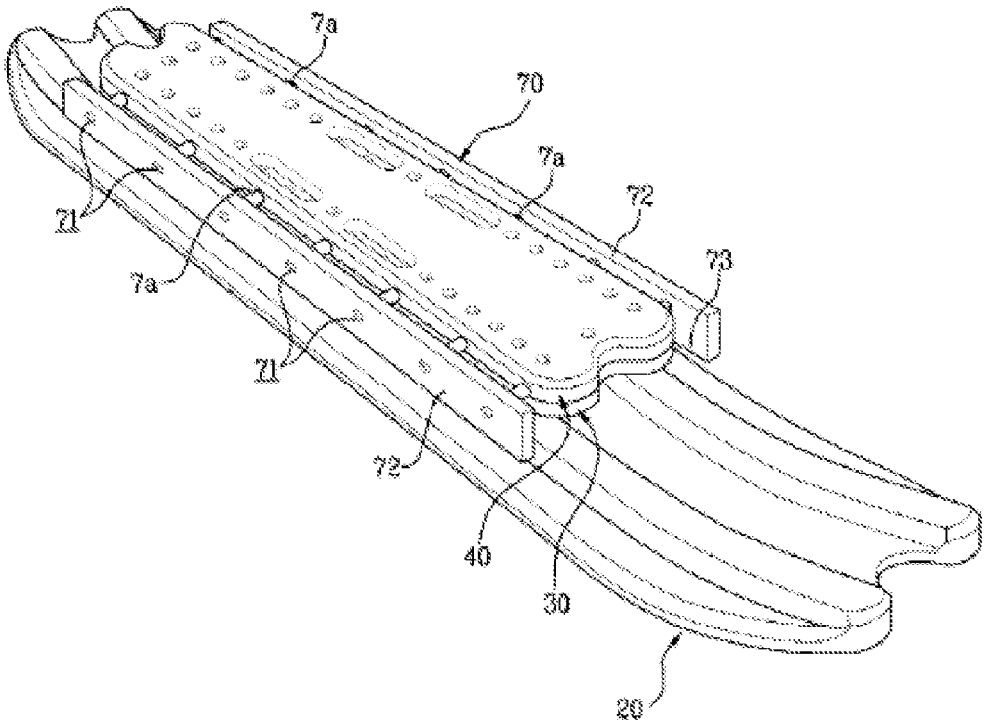
Figure 11:
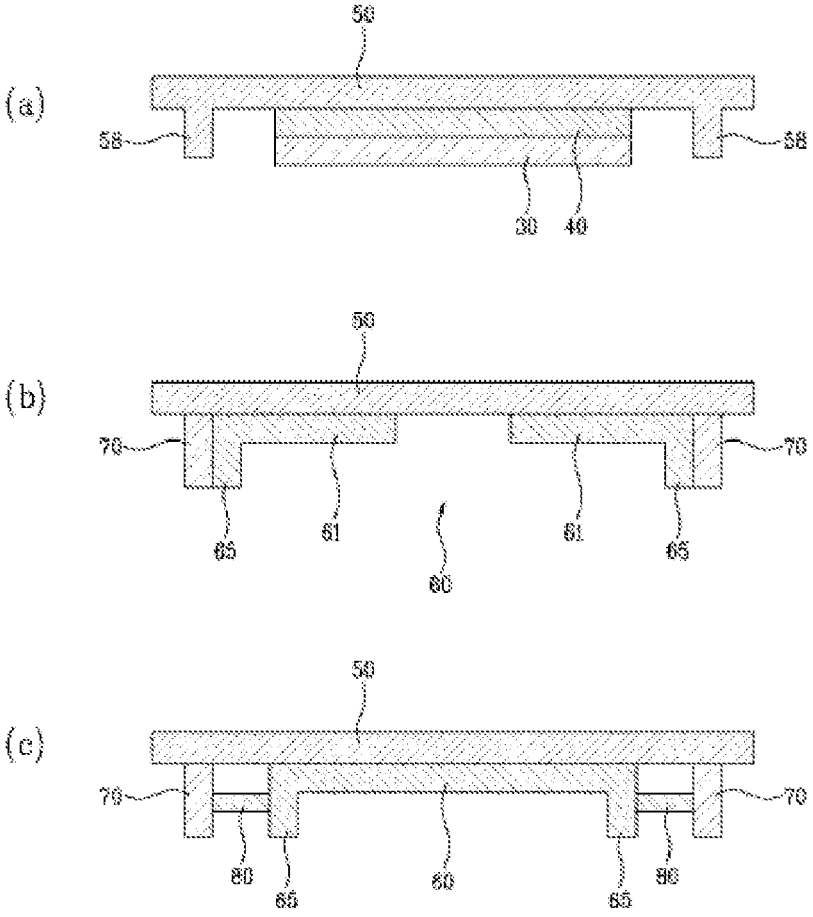
Figure 12:
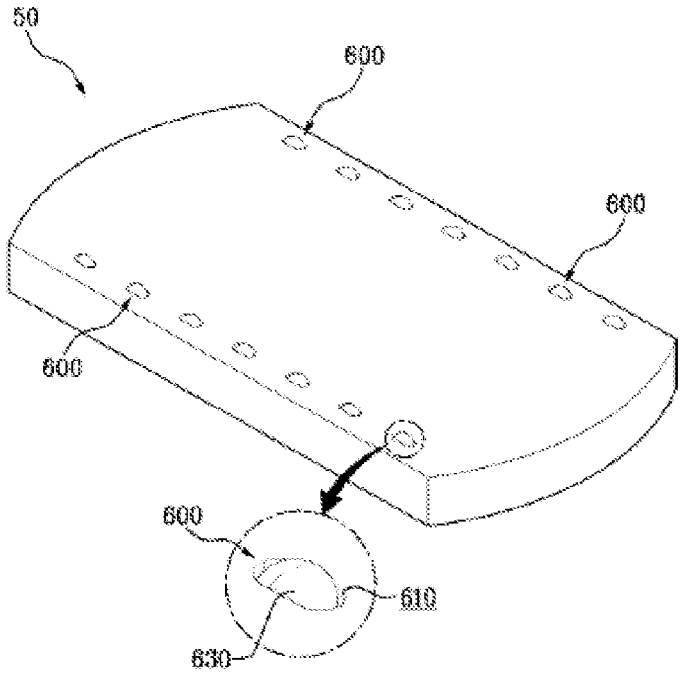
Figure 13:
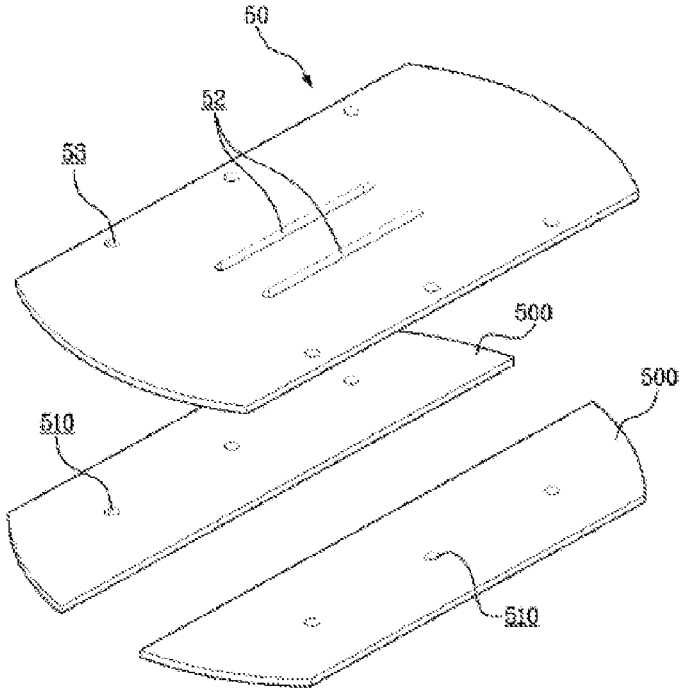

(a) to (e) of FIG. 8 are perspective views showing different embodiments of the configuration of an auxiliary sliding part that constitutes part of the present invention;

FIG. 9 is a perspective view showing the configuration of a snow sliding apparatus according to the present invention to which the embodiment of FIG. 8(*d*) has been applied;

FIG. 10 is a perspective view showing an auxiliary sliding part according to the present invention that is combined with a deck in the state of being spaced apart from each other; and (a) to (c) of FIG. 11, FIG. 12, and FIG. 13 illustrate various embodiments of wear plate.

DETAILED DESCRIPTION

According to an aspect of the present invention intended to accomplish the above-described objects, the present invention provides a snow sliding apparatus for enabling sliding along a surface of snow, including a plate-shaped deck configured to extend in a direction; and an auxiliary sliding part configured such that at least part thereof protrudes from both sides of the deck to have a width broader than and equal to that of edges of the deck, and configure to extend in the lengthwise direction of the deck, thereby protecting the edges of the deck during riding or assisting the riding of the deck.

In this case, the deck may be provided with a fastening frame that is provided on the top of the deck and is combined with the binding or boot, and the auxiliary sliding part may be combined with the fastening frame.

Furthermore, a plurality of frame holes may be formed in the auxiliary sliding part, at least any one of a fastening tool, an extension frame and a deck accessory may be fastened to the frame holes, and the extension frame may be combined with the auxiliary sliding part, thereby protecting the edges of the deck or assisting the riding of the deck, along with the auxiliary sliding part.

Specific embodiments of a snow sliding apparatus according to the present invention will be described in detail with reference to the accompanying drawings.

Figure 1:
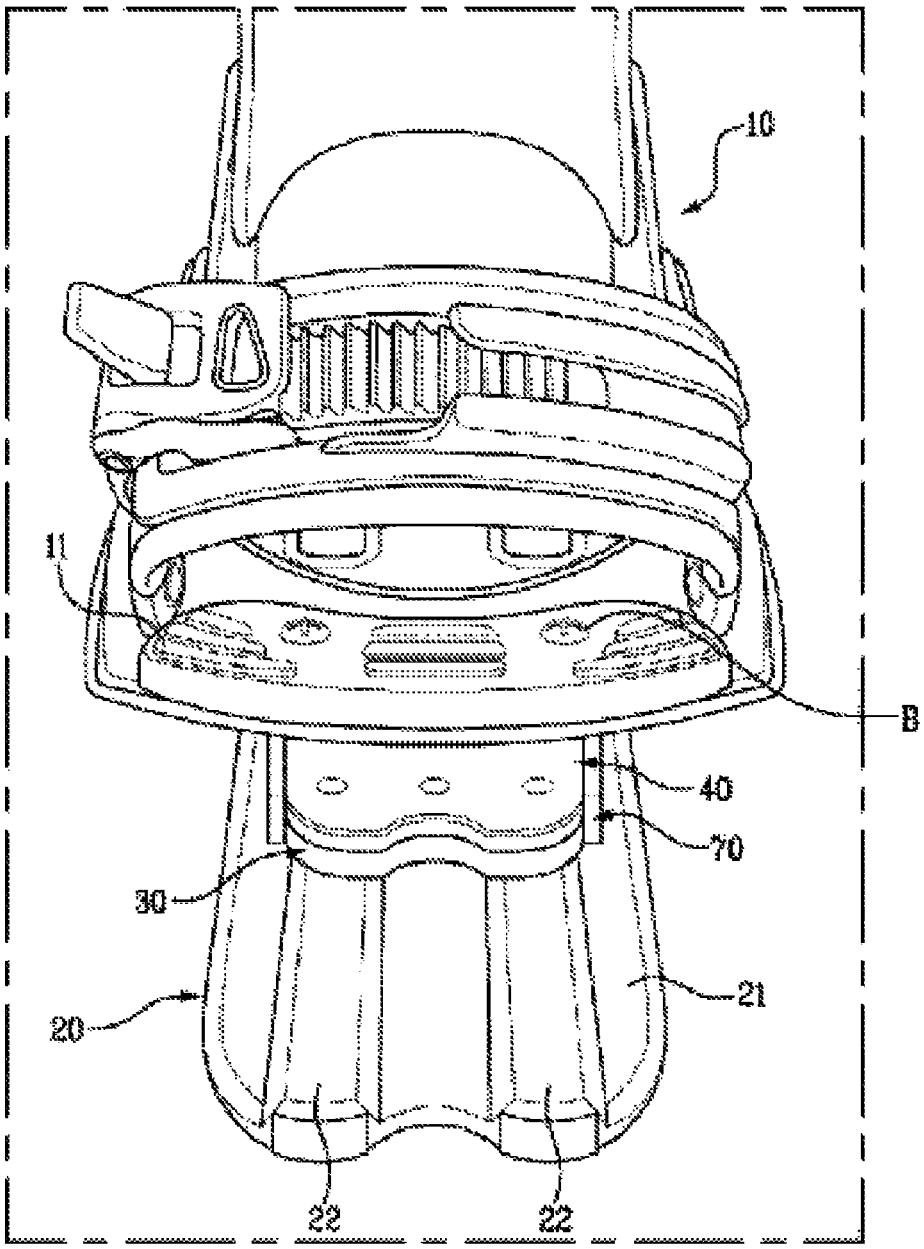
FIG. 1 is a perspective view showing the configuration of a preferred embodiment of a snow sliding apparatus according to the present invention.

In FIG. 1, the configuration of a preferred embodiment of a snow sliding apparatus according to the present invention is shown as a perspective view.

As shown in the diagram, the snow sliding apparatus according to the present invention is intended to enable a user wearing it to easily slide along the surface of snow and also to deal with various types and sizes of boots (or bindings 10) and protect the edges of a deck 20. In this case, the edges of the deck 20 refer to both side surfaces of the deck 20.

For ease of description, the binding 10 is described first. The binding 10 is combined with the top of the deck 20, and functions to fasten a boot (not shown). As shown in FIG. 1, the bottom 11 of the binding 10 is fastened onto the deck 20 by bolts B. To deal with boots, various sizes and types of bindings 10 are present. In the embodiment of the present invention, the binding 10 having a width wider than that of the deck 20 is presented by way of example. Although the binding 10 may be omitted and a boot may be directly combined with the deck 20, a snow sliding apparatus including the binding 10 is described below as an example.

In the snow sliding apparatus according to the present invention, a plate-shaped body 21 forms the appearance and skeleton of the snow sliding apparatus, as shown in FIG. 1. The body 21 may be made of various materials, such as wood, metal, alloy, synthetic resin, composite material, etc., and may be fabricated in a shape which extends parallel in a direction or whose center portion is bent upward.

It is preferred that the body 21 be formed to extend lengthily in a direction and have a smooth outside surface so that a user wearing it can slide along the surface of snow using the bottom thereof.

Protruding rails 22 are provided on the top surface of the body 21. More precisely, the protruding rails 22 are formed to protrude from the top surface of the body 21. Rail holes that enable combination with the binding 10 or a fastening frame 40 to be described are formed through the top surfaces of the protruding rails 22. In this drawing, the state of being covered with the fastening frame 40 is shown.

In this case, the protruding rails 22 are formed to protrude from the body 21, and thus enable a user to slide in the state of being spaced apart at a location above the surface of the ground. This allows the center of gravity of a user to be raised above the support of the ground, and enables various techniques due to the free acquisition of rotating force, etc.

Furthermore, the plurality of rail holes is formed along each of the protruding rails 22 at regular intervals, and thus a user can adjust a location at which the binding 10 and a boot is worn. The protruding rails 22 themselves function as a type of ribs intended to enhance the strength of the body 21, thereby improving durability regarding the overall strength and bending of the snow sliding apparatus.

Figure 3:
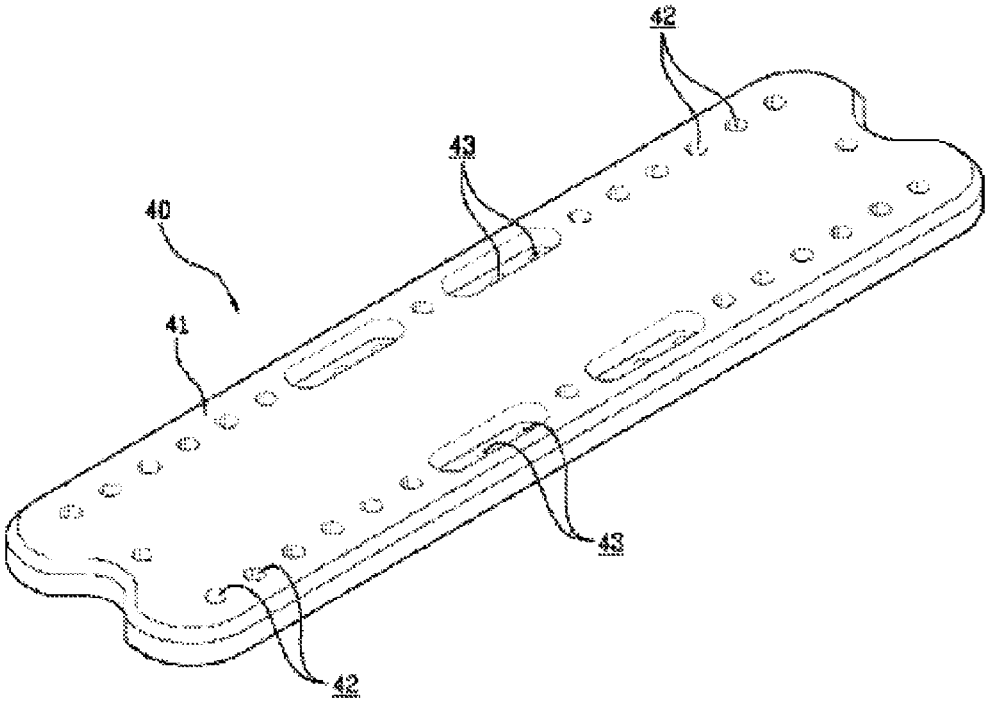
FIG. 3 is a perspective view showing the configuration of a fastening frame that constitutes part of an embodiment of the present invention.

The fastening frame 40 is combined with the deck 20. The fastening frame 40 is provided between the deck 20 and the binding 10, and functions to couple the deck 20 with the binding 10 as a medium. As shown in FIG. 3, the fastening frame 40 is provided in an approximately thin plate shape.

A plurality of binding holes 42 is formed in the fastening frame 40. The intervals between the plurality of binding holes 42 may be formed to have various widths and distances, and may deal with more various sizes and types of bindings 10. As shown in FIG. 3, the binding holes 42 are provided along both sides of the fastening frame 40. Some 43 of the binding holes 42 may be formed in the state of being depressed, and may prevent the heads of bolts from protruding.

Figure 2:
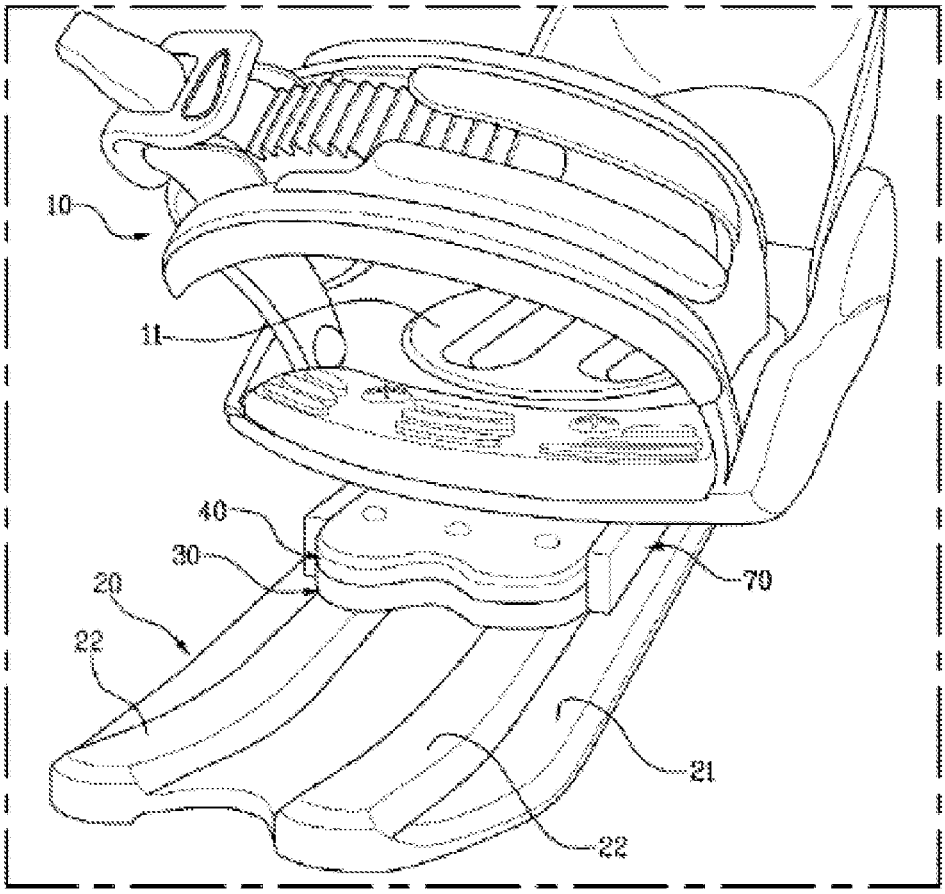
FIG. 2 is a perspective view showing the configuration of a second embodiment of a snow sliding apparatus according to the present invention.

Meanwhile, as shown in FIGS. 1 and 2, a damper spacer 30 may be provided at a location between the fastening frame 40 and the deck 20, or a location on the fastening frame 40. The damper spacer enables a user to set the desired height of the binding 10 by spacing the binding 10 and the deck 20 apart from each other. A plurality of damper spacers may be stacked on top of another. Furthermore, it is preferred that the damper spacer 30 be made of elastic material, such as silicon or rubber, so that it can perform a damping function during riding.

As shown in FIG. 1, a wear plate 50 is provided between the fastening frame 40 and the binding 10. At least part of the wear plate 50 is provided in a thin plate shape, and the wear plate 50 functions to protect the bottom surface of the binding 10. That is, the wear plate 50 comes into contact with the bottom surface of the binding 10, and prevents the surface of snow from generating direct friction with the binding 10 during riding. For this purpose, it is preferred that the wear plate 50 have a width equal to or wider than that of the bottom surface of the binding 10. In the embodiment shown in FIG. 2, the wear plate 50 is omitted.

The wear plate 50 may be made of synthetic resin, such as reinforced plastic, or metal. The outside surface of the wear plate 50 may be coated with a coating material in order to improve wear resistance.

In this case, the wear plate 50 may be composed of a plurality of segments. The plurality of segments of the wear plate 50 are fastened to the fastening frame 40 in the state of being spaced apart from each other, and thus the intervals between the plurality of segments of the wear plate 50 may be adjusted.

Figure 5:
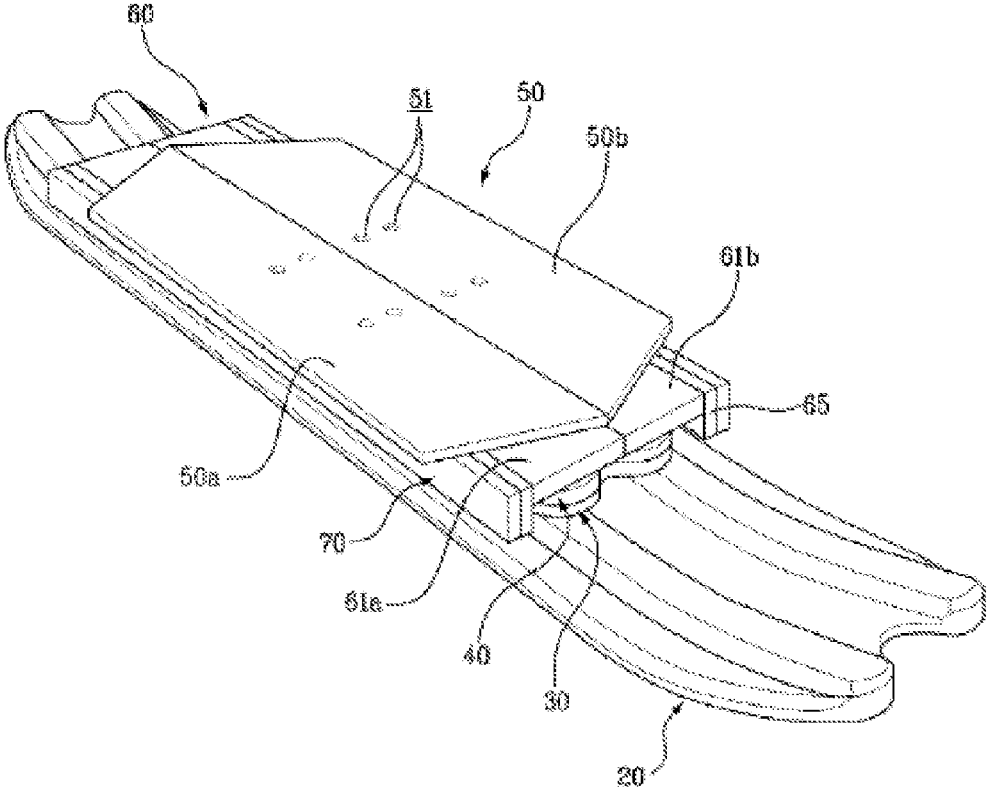
FIG. 5 is a perspective view showing a configuration with a binding eliminated from the third embodiment of the snow sliding apparatus according to the present invention.

For example, as shown in FIG. 5, the wear plate 50 may be composed of a first plate 50*a* and a second plate 50*b* that extend along the lengthwise direction of the deck 20.

In this case, first through holes 51 are formed in the wear plate 50. As shown in FIG. 5, a plurality of first through holes 51 may be formed along the first plate 50*a* and the second plate 50*b* in a single direction in parallel with each other. This is intended to deal with various specifications or sizes of bindings 10 or to adjust the location at which the binding 10 is combined.

Meanwhile, the snow sliding apparatus according to the present invention is further provided with an auxiliary sliding part 70. The auxiliary sliding part 70 is intended to protect edges corresponding to both side surfaces of the deck 20 and to assist the sliding of the deck 20. More precisely, when a user rides along an obstacle, etc. using the snow sliding apparatus, the edges chiefly generate friction with the obstacle and, thus, are easily worn. Accordingly, the auxiliary sliding part 70 comes into contact with the obstacle, thereby preventing the above problem and also further facilitating sliding.

The auxiliary sliding part 70 may be combined with the wear plate 50 or fastening frame 40. That is, the auxiliary sliding part 70 is detachably combined with the wear plate 50, or may be integrated with the wear plate 50. Alternatively, the auxiliary sliding part 70 may be detachably combined with the fastening frame 40. It will be apparent that the auxiliary sliding part 70 may be directly combined with the deck 20.

A case where the auxiliary sliding part 70 is combined with the wear plate 50 is described as an example. The auxiliary sliding part 70 may be formed in a frame shape that are coupled to both sides of the fastening frame 40, as shown in FIGS. 1 and 2. Furthermore, various embodiments of the auxiliary sliding part 70 are shown in FIG. 8. As shown in this drawing, the auxiliary sliding part 70 may be formed in a plate shape 8(*a*), an inverted and reversed "L" shape 8(*b*), or a sideways "T" shape 8(*c*). In this case, the auxiliary sliding part 70 may include a first body 75 extending in a direction parallel to the deck 20 and a second body 72 extending in a direction perpendicular to the first body 75 (see FIG. 8(*b*)).

Alternatively, as shown in FIG. 8(*d*), the auxiliary sliding part 70 may include a first body 73 extending in a direction parallel to the deck 20 and a second body 72 protruding from both ends of the first body 73 to have a width broader than or equal to the edges of the deck 20. The first body 73 may be combined with any one of the deck 20, the fastening frame 40 and the binding 10. For reference, in FIG. 9, a snow sliding apparatus in which the auxiliary sliding part 70 of this embodiment is employed is shown.

Furthermore, as shown FIG. 8(*e*), the auxiliary sliding part 70 may be rotatably provided with auxiliary sliding rolling wheels R. Reference symbol "71" denotes auxiliary holes. Various structures may be fastened to the auxiliary holes.

Meanwhile, a plurality of frame holes 71 is formed in the auxiliary sliding part 70. At least any one of a fastener (not shown), an extension frame (not shown), a deck accessory (not shown) and a fastening tool (not shown) is fastened to one of the frame holes 71. The extension frame may be combined with the auxiliary sliding part 70, and may protect the edges of the deck 20 or assist the sliding of the deck 20 along with the auxiliary sliding part 70.

Figure 4:
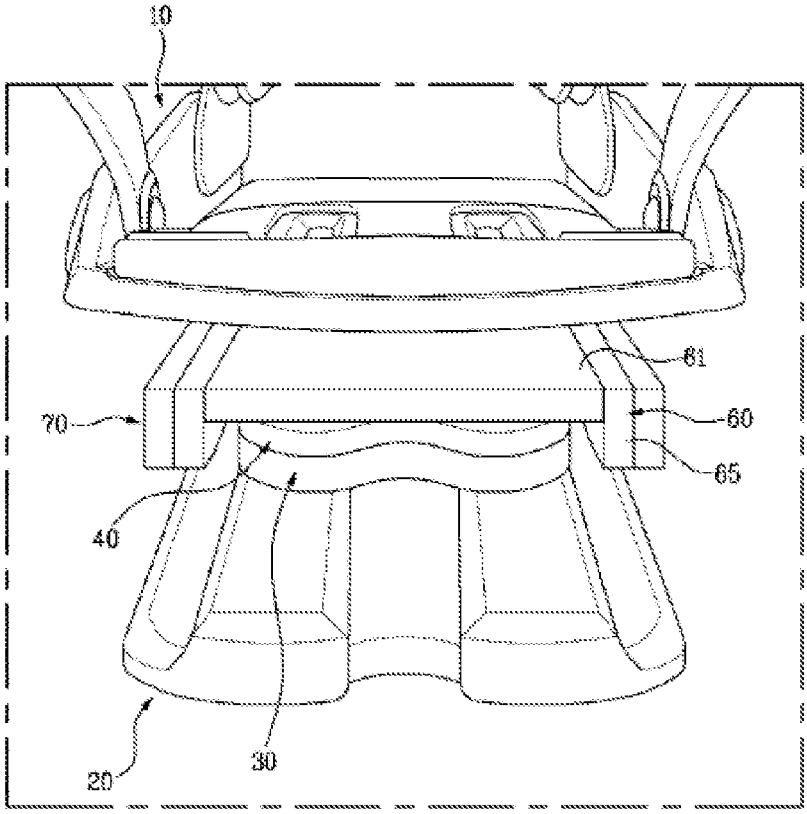
FIG. 4 is a perspective view showing the configuration of a third embodiment of a snow sliding apparatus according to the present invention.

The auxiliary sliding part 70 may be provided in a separate auxiliary sliding assembly 60. That is, as shown in FIG. 4, the auxiliary sliding assembly 60 includes a body part 61 configured to come into contact with the wear plate 50 in a plate shape in contact with the bottom surface of the wear plate 50, and side parts 65 configured to extend from both sides of the body part 61 in a perpendicular direction.

Furthermore, the auxiliary sliding part 70 is combined with the auxiliary sliding assembly 60 so that the auxiliary sliding part 70 can be selectively attached to and detached from the side part 65. The auxiliary sliding part 70 corresponds to a part that substantially generates friction with an obstacle or the like, and the auxiliary sliding assembly 60 and the auxiliary sliding part 70 may be separate or be integrated with each other.

In this case, it is preferred that the auxiliary sliding part 70 protrudes to locations corresponding to the edges of the deck 20, as shown in FIG. 5. The reason for this is that the auxiliary sliding part 70 generates friction with an obstacle instead of the edges. For example, when the obstacle has a rod shape, the obstacle may be inserted between the top surface of the deck 20 and the auxiliary sliding part 70 or be inserted into an inverted and reversed "L"-shaped depression formed by the bottom surface of the wear plate 50 and the auxiliary sliding part 70, and then may generate friction.

Figure 6:
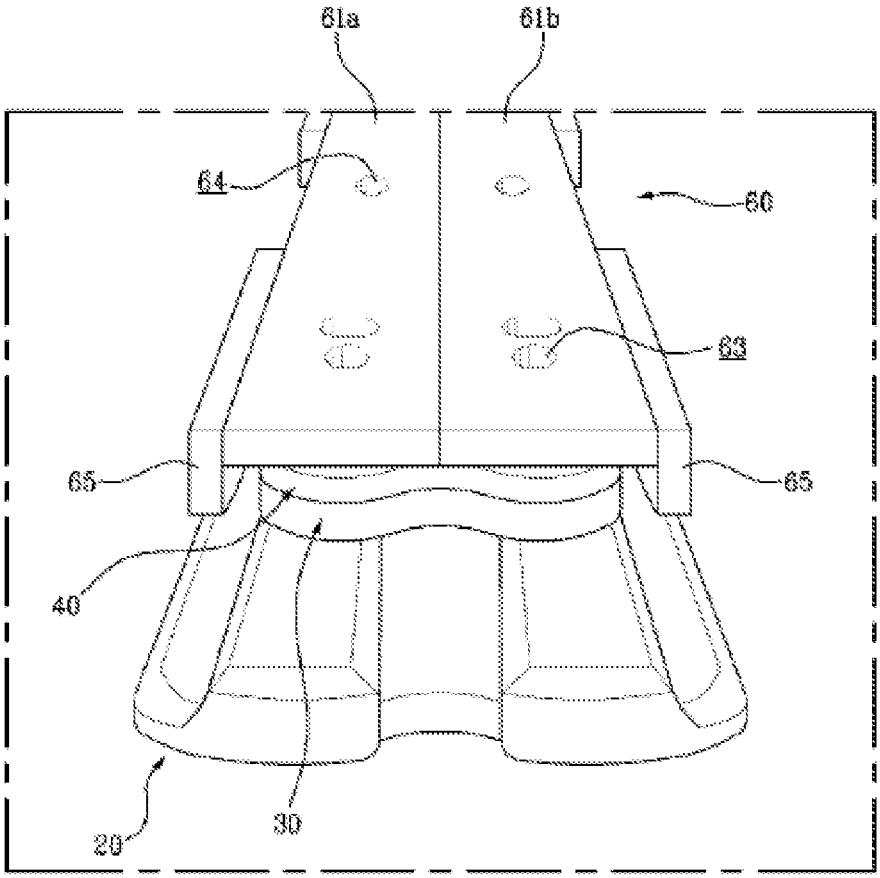
FIG. 6 is a perspective view showing a configuration with a binding, a wear plate and a protector piece eliminated from the third embodiment of the snow sliding apparatus according to the present invention.
Figure 7:
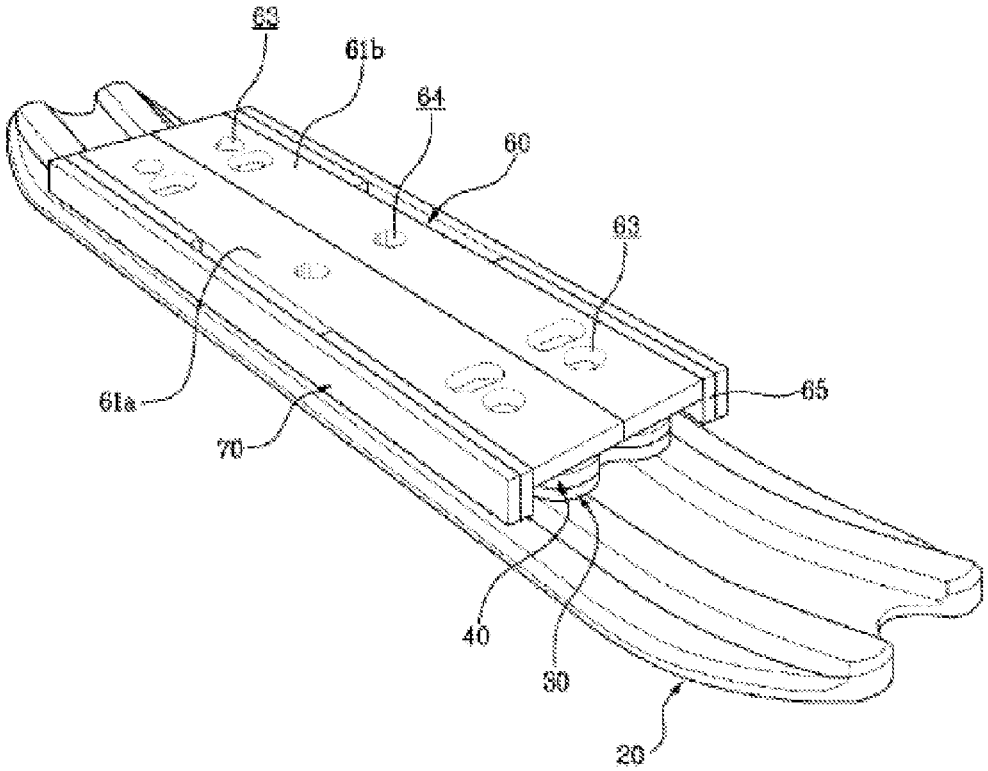
FIG. 7 is a perspective view showing a configuration with a binding and a wear plate eliminated from the third embodiment of the snow sliding apparatus according to the present invention.

Meanwhile, the auxiliary sliding part assembly 60 may also include two or more parts, like the wear plate 50, and the intervals between the parts may be variable. That is, as shown in FIG. 6, the body part 61 of the auxiliary sliding part assembly 60 may include a first body part 61*a* and a second body part 61*b*, and the intervals between the first body part 61*a* and the second body part 61*b* may be variable.

Accordingly, a user may increase the width of the auxiliary sliding part assembly 60 by a width desired by him or her, and then may use it. When necessary, the adjustment of the width may be performed along with the wear plate 50.

In this case, the body part 61 and the side parts 65 that constitute the auxiliary sliding part assembly 60 and the auxiliary sliding part 70 may be integrated with one another. More specifically, the body part 61 and the side parts 65 may be integrated with each other, and the body part 61, the side parts 65 and the auxiliary sliding part 70 may be integrated with one another. If the auxiliary sliding part 70 is separate from the remaining parts, it may be replaced when the auxiliary sliding part 70 is worn or damaged.

The auxiliary sliding part 70 may be combined with the body part 61 or side parts 65 of the auxiliary sliding part assembly 60 by fasteners 80, an adhesive, or the like.

In FIG. 10, another embodiment of the wear plate 50 according to the present invention is shown. As shown in this drawing, the auxiliary sliding part 70 may be combined with the fastening frame 40 by connectors 7*a*, and the distance from the center of the deck may be adjusted by the connectors 7*a*. It will be apparent that the auxiliary sliding part 70 may be combined with the outside surface of the deck 20, the binding 10 or the boot, instead of the fastening frame 40, by the connectors 7*a*.

The operation of the snow sliding apparatus according to the present invention is described in detail with reference to the drawings.

The process of assembling a snow sliding apparatus according to the present invention is described below. First, a user disposes the damper spacer 30 and the fastening frame 40 on the top surface of the deck 20. In this case, the damper spacer 30 may be omitted or a plurality of damper spacers may be stacked on top of another based on the height of the binding 10 desired by a user. In this case, the damper spacer 30 and the fastening frame 40 must be disposed in accordance with the rail holes formed in the protruding rails 22 of the deck 20.

In this state, the wear plate 50 is disposed on the top of the fastening frame 40. The wear plate 50 may be composed of a single body or two or more parts, as shown in FIG. 5.

In this case, when the wear plate 50 is composed of a single body, the first through holes 51 of the wear plate 50 must be aligned to correspond to the fastening holes of the fastening frame 40. It will be apparent that when a user desires, the movement of the wear plate 50 may be performed in forward and rearward directions. That is, a user may use the wear plate 50 in the state in which the wear plate 50 has been moved forward or rearward. This may be adjusted based on the specification or length of the binding 10 or boot as desired.

When the wear plate 50 includes two parts, as shown in FIG. 5, the interval between the first plate 50*a* and the second plate 50*b* may be adjusted as desired. That is, a user may adjust the interval between the first plate 50*a* and the second plate 50*b* to fit the size of the binding 10 or boot desired by the user. In this case, since the plurality of first through holes 51 is laterally formed in the first plate 50*a* and the second plate 50*b*, the first through holes 51 may correspond to the fastening holes of the fastening frame 40 even when the above adjustment is performed.

Finally, after the user has disposing the binding 10 on the top surface of the wear plate 50, the binding 10 is fastened to the wear plate 50 and the fastening frame 40, or may be directly fastened to the deck 20 via the wear plate 50, the fastening frame 40, and the damper spacer 30, using fasteners, such as bolts.

In this case, the user may additionally combine the auxiliary sliding part 70 between the wear plate 50 and the binding 10. That is, when the user rides along an obstacle using the snow sliding apparatus, the auxiliary sliding part 70 may be additionally attached in order to protect the edges.

The auxiliary sliding part 70 may be combined with the side surfaces of the fastening frame 40 or the deck 20, as shown in FIGS. 1 and 2. In some cases, the auxiliary sliding part 70 may be integrated with the fastening frame 40 or deck 20.

Furthermore, as shown in FIGS. 4 and 5, the auxiliary sliding part 70 may become part of the auxiliary sliding assembly 60, and the auxiliary sliding assembly 60 may be located between the wear plate 50 and the fastening frame 40. The auxiliary sliding assembly 60 includes the body part 61, the side parts 65 and the auxiliary sliding part 70. These parts may be assembled and then disposed on the fastening frame 40. When these parts are integrated with one another, a separate preliminary assembly process may be omitted.

The auxiliary sliding part 70 may be integrated with the bottom surface of the wear plate 50, in which case the separate assembly of the auxiliary sliding part 70 is not necessary.

Furthermore, as shown in FIG. 6, the first body part 61*a* and second body part 61*b* of the auxiliary sliding assembly 60 may be assembled while the first body part 61*a* and the second body part 61*b* are being spaced apart from each other and thus the width of the auxiliary sliding assembly 60 is being adjusted. As shown in FIG. 10, adjustment may be performed such that the auxiliary sliding part 70 is spaced from the fastening frame 40 by the connectors 7*a*.

Once the assembly of the snow sliding apparatus according to the present invention has been completed as described above, the wear plate 50 prevents direct friction between the bottom surface of a boot and the surface of snow. Furthermore, since the auxiliary sliding part 70 is provided and protects the edges of the deck 20, the edges are protected from being worn or damaged by various obstacles even when the user rides along various obstacles, such as guardrails or rails, using the deck 20.

Meanwhile, in FIG. 11, various embodiments of the wear plate 50 are shown. First, in FIG. 11(*a*), an embodiment in which the auxiliary sliding part 58 has been integrated with the bottom surface of the wear plate 50 is shown. That is, without the assembly of the separate auxiliary sliding assembly 60, the auxiliary sliding part 58 may be provided directly on the bottom surface of the wear plate 50, as shown in FIG. 11(*a*). In this case, the auxiliary sliding part 58 has been assigned a separate reference symbol in order to distinguish it from the separate auxiliary sliding part 70.

Furthermore, as shown in FIG. 11(*b*), the auxiliary sliding assembly 60 may be combined with the bottom surface of the wear plate 50, and may be assembled while two parts thereof are being spaced apart from each other and thus the width of the auxiliary sliding assembly 60 is being adjusted, in which case the auxiliary sliding part 70 is combined with the side parts 65 of the two parts.

Furthermore, as shown in FIG. 11(*c*), the auxiliary sliding part 70 may be combined with the auxiliary sliding assembly 60 so that it is spaced apart from the side parts 65 of the auxiliary sliding assembly 60. For this purpose, the fasteners 80, spacers (not shown) or the like may be provided between the auxiliary sliding part 70 and the side parts 65.

Meanwhile, in FIG. 12, still another embodiment of the wear plate 50 according to the present invention is shown. As shown in this drawing, plate rolling wheels 600 are provided in the wear plate 50. The plate rolling wheels 600 are provided in the wear plate 50, and enable natural sliding between the wear plate 50 and an obstacle when a user rides along an obstacle or the like using the snow sliding apparatus. For this purpose, it is preferred that at least part of the plate rolling wheels 600 be formed to protrude from the wear plate 50.

The plate rolling wheels 600 may be formed in various shapes. Ball-shaped plate rolling wheels 600, wheel-shaped plate rolling wheels 600 or the like may be provided. The plate rolling wheels 600 may protrude above and below the wear plate 50, or may protrude below the wear plate 50.

Furthermore, in FIG. 13, another embodiment of the wear plate 50 according to the present invention is shown. As shown in this drawing, assembly blocks 500 may be detachably combined with the bottom surface of the wear plate 50. The assembly blocks 500 may function as parts that are combined with the bottom surface of the wear plate 50 and substantially come into contact with the surface of snow.

The shapes of the assembly blocks 500 may be varied in various forms. In the present embodiment, the outside surfaces of the assembly blocks 500 are coated with a Teflon coating in order to reduce friction and improve durability. Furthermore, first fastening holes 53 and second fastening holes 510 may be formed in the wear plate 50 and the assembly blocks 500 at corresponding locations, and may be coupled by separate fasteners.

The rights of the present invention are not limited to the above-described embodiments, but are defined based on the descriptions of the claims. It will be apparent to those having common knowledge in the field of the present invention that various modifications and alterations can be made within the range of rights described in the claims.

For example, although examples in which the plurality of rail holes 23 are formed along the protruding rails 22 at regular intervals and the fastening frame 40 is fastened to the rail holes 23 have been described in the embodiments, the fastening frame 40 and the auxiliary sliding part 70 may be applied to a general deck in which the protruding rails 22 and the rail holes 23 have not been formed. In this case, the auxiliary sliding part 70 may be fastened to the deck using the fastening frame 40.

The present invention relates to a snow sliding apparatus that enables sliding along the surface of snow, in which a user can freely set his or her desired riding height, thereby improving the manipulability of the snow sliding apparatus.

What is claimed is:

1. A snow sliding apparatus for enabling sliding along a surface of snow, comprising:

a plate-shaped deck configured to extend in a direction; and an auxiliary sliding part configured such that at least part thereof protrudes from both sides of the deck to have a width broader than or equal to that of edges of the deck, and configure to extend in a lengthwise direction of the deck, thereby protecting the edges of the deck during riding or assisting riding of the deck, wherein the auxiliary sliding part is combined with an outside surface of the deck and one side of a binding or boot, or is integrated with the deck, binding or boot, and wherein the deck is further provided with a fastening frame that is provided on a top of the deck and is combined with the binding or boot, and the auxiliary sliding part is combined with the fastening frame.

2. The snow sliding apparatus of claim 1, wherein the auxiliary sliding part comprises a first body configured to extend a direction parallel to the deck and second bodies configured to protrude from both ends of the first body to have a width broader than and equal to that of edges of the deck, and the first body is combined with any one of the deck, the fastening frame, and the binding.

3. The snow sliding apparatus of claim 1, wherein the auxiliary sliding part comprises a pair of parts and is provided on both sides of the deck, and the auxiliary sliding part comprises a first body extending in a direction parallel to the deck and second bodies extending in a direction perpendicular to the first body.

4. The snow sliding apparatus of claim 1, wherein:

the deck is provided with an auxiliary sliding assembly;

the auxiliary sliding assembly comprises a body part formed in a plate shape and side parts configured to extend from both sides of the body part in a direction perpendicular to the body part; and the auxiliary sliding part is detachably combined with the side parts.

5. The snow sliding apparatus of claim 1, wherein a plurality of frame holes is formed in the auxiliary sliding part, at least any one of a fastener, an extension frame, a deck accessory and a fastening tool is fastened to the frame holes, and the extension frame is combined with the auxiliary sliding part, thereby protecting the edges of the deck or assisting riding of the deck, along with the auxiliary sliding part.

6. The snow sliding apparatus of claim 1, wherein a wear plate configured to prevent direct contact between a surface of snow and the boot or binding is provided between a top surface of the deck and a bottom surface of the binding or boot combined with the deck.

7. A snow sliding apparatus for enabling sliding along a surface of snow, comprising:

a plate-shaped deck configured to extend in a direction; and an auxiliary sliding part configured such that at least part thereof protrudes from both sides of the deck to have a width broader than or equal to that of edges of the deck, and configure to extend in a lengthwise direction of the deck, thereby protecting the edges of the deck during riding or assisting riding of the deck, wherein a plurality of frame holes is formed in the auxiliary sliding part, at least any one of a fastener, an extension frame, a deck accessory and a fastening tool is fastened to the frame holes, and the extension frame is combined with the auxiliary sliding part, thereby protecting the edges of the deck or assisting riding of the deck, along with the auxiliary sliding part, and wherein the auxiliary sliding part is rotatably provided with auxiliary sliding rolling wheels.

8. The snow sliding apparatus of claim 7, wherein the auxiliary sliding part is combined with an outside surface of the deck and a binding, boot or fastening frame by a connector, and a distance from a center of the deck is adjustable by the connector.

9. A snow sliding apparatus for enabling sliding along a surface of snow, comprising:

a plate-shaped deck configured to extend in a direction; and an auxiliary sliding part configured such that at least part thereof protrudes from both sides of the deck to have a width broader than or equal to that of edges of the deck, and configure to extend in a lengthwise direction of the deck, thereby protecting the edges of the deck during riding or assisting riding of the deck, wherein a wear plate configured to prevent direct contact between a surface of snow and the boot or binding is provided between a top surface of the deck and a bottom surface of the binding or boot combined with the deck, and wherein the auxiliary sliding part is combined with a side surface or bottom surface of the wear plate, or is integrated with the wear plate.

10. The snow sliding apparatus of claim 9, wherein at least part of the wear plate is formed in a thin plate shape extending in a lengthwise direction of the deck, and a first through hole configured to combine the binding or boot with the deck is formed in the wear plate.

11. The snow sliding apparatus of claim 10, wherein the auxiliary sliding assembly comprises two symmetrical parts, and an interval between these two parts is variable.

12. The snow sliding apparatus of claim 11, wherein the auxiliary sliding part is combined with the body part or side parts of the auxiliary sliding assembly by a fastener, and a distance from a center of the deck is adjustable by the fastener.

13. The snow sliding apparatus of claim 12, wherein the wear plate and the auxiliary sliding assembly are integrated with each other, or the wear plate, the auxiliary sliding assembly and the fastening frame are integrated with one another.

14. The snow sliding apparatus of claim 13, wherein an assembly block is detachably combined with a bottom surface of the wear plate.

15. The snow sliding apparatus of claim 14, wherein a first fastening hole and a second fastening hole are formed in the wear plate and the assembly block, respectively, at corresponding locations, and outside surfaces of the assembly block are coated with a Teflon coating.

16. The snow sliding apparatus of claim 15, wherein the wear plate is provided with plate rolling wheels, and at least part of each of the plate rolling wheels protrudes from the wear plate.

* * * * *